United States Patent [19]

Johnson

[11] 3,957,133

[45] May 18, 1976

[54] MUFFLER

[75] Inventor: John Leslie Johnson, Morrisville, N.C.

[73] Assignee: Scovill Manufacturing Company, Waterbury, Conn.

[22] Filed: Sept. 10, 1975

[21] Appl. No.: 612,204

[52] U.S. Cl. ..... 181/60; 181/50; 181/67

[51] Int. Cl.[2] ..... F01N 1/08

[58] Field of Search ..... 181/50, 55, 56, 66, 181/67, 60

[56] References Cited

UNITED STATES PATENTS

| | | | |
|---|---|---|---|
| 822,127 | 5/1906 | Hufnagel | 181/60 |
| 1,808,170 | 6/1931 | Kamrath | 181/71 |
| 3,688,870 | 9/1972 | Gibel | 181/60 |
| 3,880,252 | 4/1975 | Mucka | 181/60 |

*Primary Examiner*—Stephen J. Tomsky
*Attorney, Agent, or Firm*—Dallett Hoopes

[57] ABSTRACT

Muffler having a metal wool outlet barrier has central corepiece comprising a helically ribbed and slotted tube which immobilizes the mass of metal wool and uniformly delivers exhaust fluid thereto.

5 Claims, 5 Drawing Figures

MUFFLER

BACKGROUND OF THE INVENTION

1. Field of the Invention

This invention relates to mufflers. More specifically, the invention relates to mufflers of the type comprising a perforated cylinder and containing a metal wool to disperse the impact of sound waves.

2. Description of the Prior Art

In the prior art, there are a large number of compact hollow mufflers adapted to be connected to the exhaust fitting of a diesel air starter, compressor, engine or the like, and to provide a chamber having porous outlet means designed to diffuse the sound waves passing therethrough. Such mufflers, while inexpensive, have been surprisingly effective for their size.

Examples of such prior art mufflers are found in the U.S. Pat. No. 3,380,553, issued Apr. 30, 1968 to S. J. Gibel and U.S. Pat. No. 2,815,088, issued Dec. 3, 1957 to S. J. Gibel.

In the prior art, there has been usage of metal fibers or wool as a medium through which to pass the exhaust gases to diffuse sound associated therewith. The use of such wool is preferred to woven or screen material because it is able to endure longer exhaust cycles than the other forms without "icing up". The use of such wool, however, has presented problems in that the wool invariably needs to be supported and has compacted toward the end of the muffler more remote from the inlet end, leaving a free passage adjacent the inlet end for the exhaust fluid with no sound reduction. A further problem in the use of brass wool has been the provision of adequate means to uniformly distribute the incoming exhaust gas evenly through the full extent of the metal wool extending the length of the muffler.

SUMMARY OF THE INVENTION

In the present invention, there is provided in a hollow muffler chamber, a thin-walled tubular corepiece having outstruck helical ribs thereon, the ribs each being formed with slots adapted not only to uniformly distribute the incoming exhaust gas but also to immobilize the metal wool compressed in the annular space between the corepiece and the perforated cylindrical sidewall of the muffler. Retaining means are provided to support the corepiece in a disposition axial of the muffler.

BRIEF DESCRIPTION OF THE DRAWINGS

Other objects and features of the invention will be apparent to those skilled in the art from a review of the following specification, including the accompanying drawings, all of which disclose a non-limiting but preferred embodiment of the invention. In the drawings.

DESCRIPTION OF THE PREFERRED EMBODIMENT

Figure 1:
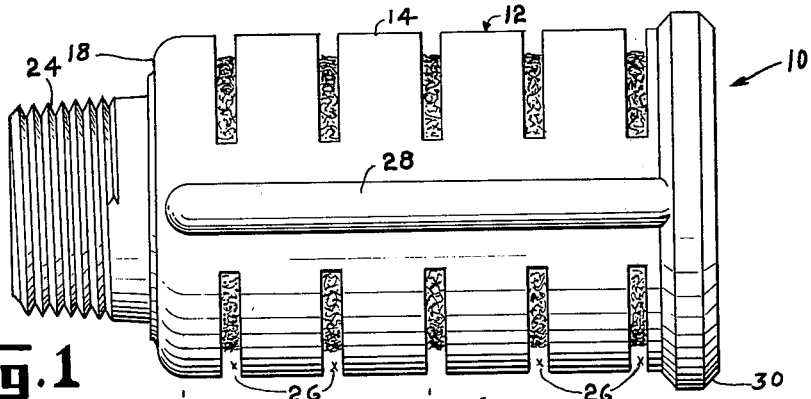
FIG. 1 is a side view of a muffler embodying the invention.

A muffler embodying the invention is generally designated 10 in FIG. 1. It is essentially a hollow cylindrical housing 12 comprising a cylindrical sidewall 14, an imperforate end wall 16, and an opposite end wall 18. End wall 18 is formed with a central inlet opening 20 providing an annular shoulder 22. As shown, connected to the end wall 18 in the opening 20 is a threaded inlet connection 24.

Figure 4:
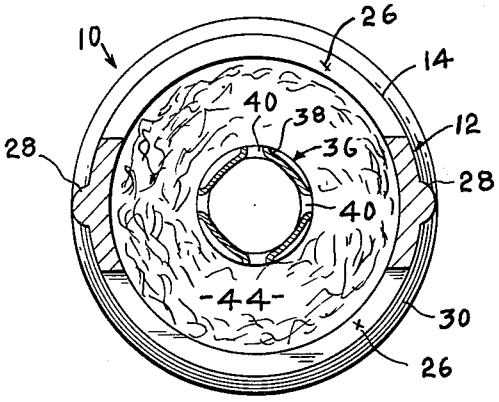
FIG. 4 is a sectional view taken on the line 4—4 of FIG. 2.

The sidewall 14 on the housing is formed with a plurality of longitudinally-spaced partial peripheral slots 26. Inbetween slots, the housing is thickened on opposite sides with reinforcing ribs 28 (FIG. 4). At the opposite end from the inlet 24, the rim of the sidewall is thickened as at 30 and its inner diameter is enlarged to receive the circular end wall 16. An annular groove 32 is provided in the rim 30 to receive a retaining ring 34 holding the end wall 16 in position against shoulder **30*a***.

The sidewall 14, end wall 18, and connection 24 of the housing may be an integral aluminum casting, for instance.

Disposed along the axis of the housing is a corepiece 36. As shown, the corepiece is a thin-walled tubular element having outwardly-struck uniformly-spaced ribs or ridges 38 disposed barber-pole fashion on the corepiece. These ridges, more technically speaking in the shape of helices, extend from one end of the corepiece to the other end. In a substantial zone intermediate the ends of the corepiece, the peaks of the ridges are machined away to leave helical slots 40.

The tubing having the helical ribs is a commercially available product sometimes referred to inaccurately as "spiral fluted tubing" and may be made, for instance, as shown in the U.S. Pat. No. 3,375,690 which issued Apr. 2, 1968 to L. S. Fink, or U.S. Pat. No. Re. 24,783, issued Feb. 16, 1960 to R. P. Humphrey.

Figure 2:
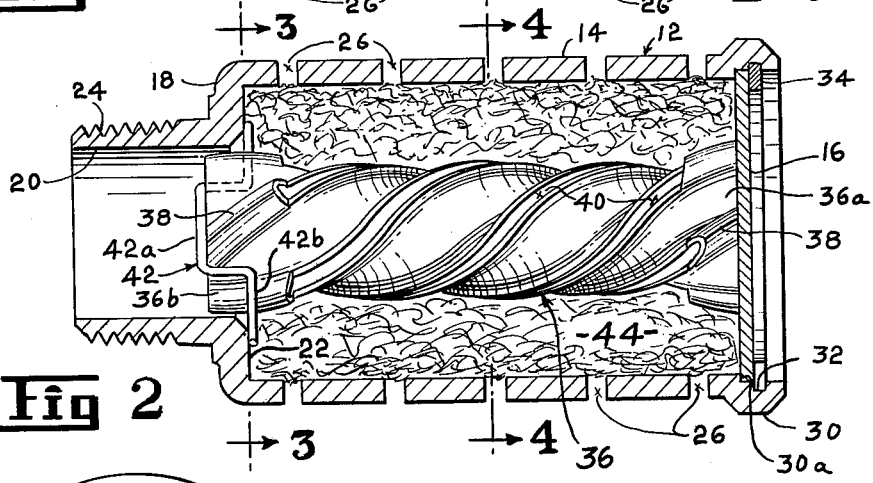
FIG. 2 is a sectional view of the muffler shown in FIG. 1.
Figure 3:
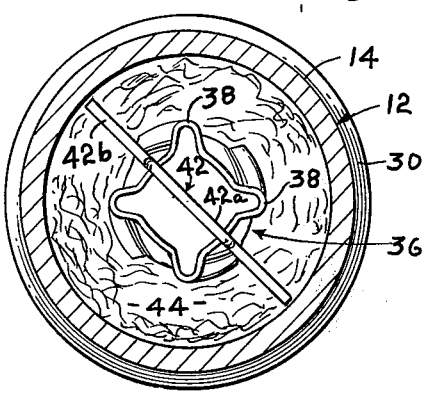
FIG. 3 is a sectional view taken on the line 3—3 of FIG. 2.
Figure 5:
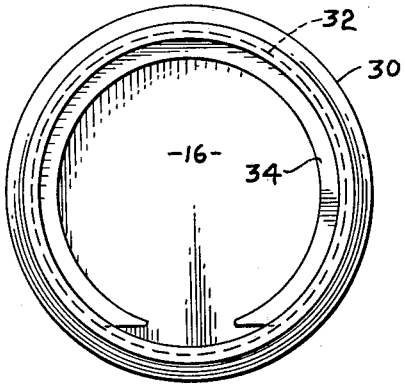
FIG. 5 is an end view showing the imperforate end wall of the muffler embodying the invention.

As shown, one end **36*a* of the tubular corepiece 36 butts against the end wall 16 while the other end 36*b* is disposed in the opening 20 of the end wall 18. A wire-retaining means 42 is provided to urge the corepiece 36 toward the wall 16. As shown, the retaining means 42 is substantially planar and is formed with an offset central run 42*a* which engages the end 36*b* of the corepiece while the opposite end runs 42*b* engage the shoulder 22 (FIG. 2**).

Compressed into the annular space between the corepiece 36 and the sidewall 14 is metal wool 44. This may be brass or bronze wool, and not being compressed in place, there is assurance that fluid passing into the muffler will have to pass through the metal wool in order to get out through the openings 26. The ridges 38, extending outward into the body of metal wool, immobilize the metal wool, keeping it from being compressed by incoming fluid down toward the end wall 16. At the same time, the interior shape of the corepiece 36, having helical grooves as shown, causes the incoming fluid to swirl about as it approaches the end plate 16, and to be more or less evenly distributed out through the helical slots 40 into the mass of metal wool. From the mass of metal wool, the fluid passes through the spaced slots 26 into the atmosphere.

It should thus be clear that the provision of the helical grooves 38 and helical slots 40 afford advantages not suggested by the prior art.

While the invention has been described in a single embodiment, it is not so limited but may be embodied in many various structures, all falling within the scope of the following claim language:

I claim:

1. A muffler comprising a hollow cylindrical housing having a sidewall and end walls at either end, one end wall having an axial opening and an inlet connection, said one end wall providing an inwardly-facing annular shoulder surrounding the opening, the other end being imperforate, the sidewall of the housing being formed with aperture means, a corepiece having a diameter approximately equal to the inside diameter of the opening and comprising a thin-walled tubular element being formed with outstruck uniformly spaced helical ridges, the ridges having slots along the peaks thereof for a portion of the length of the ridges, the first end of the tubular element butting against the said other end wall of the housing, retaining means associated with the said one end wall of the housing and engaging the second end of the tubular element to urge said element toward the said other end wall, and a body of metal wool compressed in the annular space between the tubular corepiece and the sidewall of the housing, whereby the helical ridges serve to hold the body of the metal wool from moving along said annular space away from the one end of the housing and the slots along the peaks of the ridges distribute the fluid coming through the inlet into the wool.

2. A muffler comprising a hollow cylindrical housing having a sidewall and end walls at either end, one end wall having an axial opening and an inlet connection, said one end wall providing an inwardly-facing annular shoulder surrounding the opening, the other end being imperforate, the sidewall of the housing being formed with a plurality of peripheral slots spaced longitudinally of the housing, a corepiece having a diameter approximately equal to the inside diameter of the opening and comprising a thin-walled tubular element being formed with outstruck uniformly spaced helical ridges, the ridges having slots at the peaks thereof, the first end of the tubular element butting against the other end wall of the housing, wire retaining means engaging the shoulder and holding the second end of the corepiece, and a body of metal fibers compressed in the annular space between the tubular corepiece and the sidewall of the housing, whereby the helical ridges serve to hold the fibers from moving along said annular space away from the one end of the housing, and the slots on top of the ridges distribute the fluid coming through the inlet.

3. A muffler as claimed in claim 2 wherein the wire retaining means is essentially planar and has a central offset portion engaging the second end of the tubular corepiece and is disposed in the inlet connection, and the opposite ends of the retaining means engage the shoulder on opposite sides of the opening.

4. A muffler as claimed in claim 1 wherein the helical ridges extend from one end of the corepiece to the other and the slots are formed by machining off the top of the ridges at locations intermediate the ends of the corepiece.

5. A muffler as claimed in claim 1 wherein the body of metal fibers centers the first end of the corepiece with respect to the axis of the housing.

* * * * *